US007911144B2

(12) United States Patent
Ansems et al.

(10) Patent No.: US 7,911,144 B2
(45) Date of Patent: Mar. 22, 2011

(54) METAL HALIDE LAMP AND VEHICLE HEADLAMP

(75) Inventors: Johannes Petrus Maria Ansems, Eindhoven (NL); Josephus Christiaan Maria Hendricx, Eindhoven (NL); Herman Muller, Turnhout (BE)

(73) Assignee: Koninklijke Philips Electronics N.V., Eindhoven (NL)

( * ) Notice: Subject to any disclaimer, the term of this patent is extended or adjusted under 35 U.S.C. 154(b) by 502 days.

(21) Appl. No.: 10/556,009

(22) PCT Filed: May 6, 2004

(86) PCT No.: PCT/IB2004/050606

§ 371 (c)(1),
(2), (4) Date: Nov. 8, 2005

(87) PCT Pub. No.: WO2004/100212

PCT Pub. Date: Nov. 18, 2004

(65) Prior Publication Data

US 2007/0007896 A1 Jan. 11, 2007

(30) Foreign Application Priority Data

May 12, 2003 (EP) ..... 03101302
Jun. 19, 2003 (EP) ..... 03101797

(51) Int. Cl.
*H01J 17/16* (2006.01)
*H01J 61/30* (2006.01)

(52) U.S. Cl. ..... 313/634; 313/635; 313/637; 313/638; 313/573; 313/17; 313/317; 313/111

(58) Field of Classification Search ..... 313/634, 313/635, 637, 638, 573, 17, 110, 111, 317
See application file for complete search history.

(56) References Cited

U.S. PATENT DOCUMENTS

| | | | | |
|---|---|---|---|---|
| 6,169,367 | B1 | 1/2001 | Muto et al. | |
| 2003/0031026 | A1 * | 2/2003 | Tiesler-Wittig | 362/512 |
| 2004/0156984 | A1 * | 8/2004 | Vitt et al. | 427/162 |

FOREIGN PATENT DOCUMENTS

| | | | |
|---|---|---|---|
| GB | 1314317 | A | 4/1973 |
| JP | 02168551 | A | 6/1990 |
| WO | 0067294 | A | 11/2000 |

OTHER PUBLICATIONS

ISR, Written Opinion of The International Searching Authority PCT/IB2004/050606.

* cited by examiner

*Primary Examiner* — Nimeshkumar D Patel
*Assistant Examiner* — Thomas A Hollweg

(57) ABSTRACT

The invention relates to a metal halide lamp for a vehicle headlamp comprising a cylindrically-shaped discharge vessel (23) having a ceramic wall which encloses a discharge space comprising Xe and ionizable filling, and a cylindrically-shaped outer bulb (21) surrounding the discharge vessel (23). According to the invention a portion (25, 26) of the surface of the outer bulb (21) facing away from the discharge vessel (23) is shaped as a negative lens. Preferably, the portion (25, 26) encompasses a segment of the outer bulb (21) with a segment angle $\alpha$ in the range between $30 \leqq \alpha \leqq 60°$. Preferably, the portion (25) forming the negative lens is shaped as a flat surface.

11 Claims, 5 Drawing Sheets

METAL HALIDE LAMP AND VEHICLE HEADLAMP

The invention relates to a metal halide lamp for a vehicle headlamp comprising a cylindrically-shaped discharge vessel along a longitudinal axis, said discharge vessel having a ceramic wall which encloses a discharge space comprising Xe and an ionizable filling, and a cylindrically-shaped outer bulb surrounding the discharge vessel along the longitudinal axis.

The invention further relates to a vehicle headlamp comprising a reflector and a metal halide lamp.

A lamp of the kind mentioned in the opening paragraph is known from WO-A 00/67294-A (PHN 17.434). The known metal halide lamp with a filling of Hg, Xe and NaCe iodide has compact dimensions (internal diameter less than 2 mm), a relatively high luminous efficacy (above 75 lm/W) and good color properties (among which a general color rendering index CRI of between 50 and 65 and a color temperature CCT of between 3000 and 4000 K) which render the lamp highly suitable for use in a headlamp for a motor vehicle.

A ceramic wall in the present description and conclusions is understood to mean both a wall made of metal oxide, such as, for example, sapphire densely sintered polycrystalline $Al_2O_3$ or YAG, and a wall made of metal nitride, for example AlN.

A disadvantage of the known lamp is that the service life of the metal halide lamp is below the desired level.

The invention has for its object to provide a measure by which the above disadvantage is eliminated. According to the invention, a metal halide lamp of the kind mentioned in the opening paragraph is for this purpose characterized in that a portion of the surface of the outer bulb facing away from the discharge vessel is shaped as a negative lens.

For the application of lamps in vehicle headlamps, requirements for automotive passing beam patterns have been laid down. These (legal) requirements prescribe, amongst others, the creation of a relatively sharp so-called cut-off between the illuminated area and the glare area of the light beam emitted by the vehicle headlamp measured at a certain distance of the vehicle. (In fact, the requirements prescribe point/regions just above and below said cut-off.) For a metal halide lamp applied in a vehicle headlamp, these requirements can be met if the thickness of the wall and/or the internal diameter of the discharge vessel are sufficiently small. These dimensional requirements, however, give rise to relatively high wall temperatures in the discharge vessel. These relatively high wall temperatures have a negative influence on the lifetime of the metal halide lamp. By increasing the diameter and/or the wall thickness of the discharge vessel, the wall temperatures would be lowered but this has the disadvantage that it becomes optically more difficult to meet the requirements for automotive passing beam patterns. In addition, a thicker wall of the discharge vessel results in a higher luminance at the edges of the discharge vessel. A larger (internal) diameter of the discharge vessel leads to larger images of the discharge vessel as projected by the light beam emitted by the vehicle headlamp measured at a certain distance of the vehicle. In general, a thicker wall leads to more scattering by the wall material and to a higher luminance of the tube edges and a lower luminance in the center of the tube. If the position of the tube images in the beam pattern is such that 20% of the maximum luminous flux is positioned exactly on the cut-off line the tube edges with higher luminance will be positioned just above the cut off line in the glare area, resulting in more glare. A larger (internal) diameter of the discharge vessel also leads to a less steep luminance gradient along a cross-section of the discharge vessel. Such consequences make it more difficult to realize a sufficiently high illumination as well as the desired sharp cut-off according to the requirements for automotive passing beam patterns.

The inventors have had the insight that by shaping a portion of the outer bulb facing away from the discharge vessel as a negative lens, the discharge vessel virtually becomes smaller. This means that the light emitted by the combination of the discharge vessel and the outer bulb appears to originate from a smaller sized discharge vessel. This implies that the (real) dimensions of the discharge vessel and the outer bulb can be increased to lower the wall temperatures. This would give rise to an improved life of the metal halide lamp. Virtually the dimensions of a discharge vessel surrounded by an outer bulb with a negative lens can remain more or less the same as compared to the dimensions of a discharge vessel surrounded by an outer bulb without the negative lens. In practice, it was found out that by shaping the discharge vessel somewhat larger than according to the original dimensions but still smaller than the virtual dimensions of the original discharge vessel surrounded by an outer bulb with a negative lens, the discharge vessel surrounded by the outer bulb with negative lens according to the invention can be used to improve the illumination and the sharpness of the cut-off of the beam. By increasing the dimensions of the discharge vessel according to the invention the illumination properties are improved while at the same time the service life of the metal halide lamp is prolonged.

The metal halide lamp according to the invention has the advantage that the discharge vessel has very compact virtual dimensions which render the lamp highly suitable for use in a headlamp for a motor vehicle. Owing to the small internal diameter in comparison with the electrode spacing, and thus the discharge arc length, the discharge arc is hemmed in by the discharge vessel wall, so that the discharge arc has a sufficiently straight shape for it to be suitable for use as a light source for a motor vehicle headlamp. An internal diameter $d_i \leqq 2$ mm is found suitable for realizing a sharp beam delineation necessary for use in (motor) vehicles in combination with a small spot of high brightness immediately adjacent this delineation. Such a very small internal diameter renders the lamp particularly suitable for use as a light source in a complex-shape headlamp, or alternatively in a so-called free-form collector. Such reflectors have the advantage that the cut-off can be build up without any shielding of the light source. An advantage of such a headlamp is that no separate passing-beam cap is required in the formation of the light beam to be generated in order to realize a sufficiently sharp beam delineation. The $d_i$ is chosen to be so great that a minimum switching life of 2000 hours can be realized. The metal halide lamp according to the invention is particularly suitable for use in a headlamp with a European passing beam when the internal diameter $d_i$ is chosen such that the relation $d_i \leqq 2$ mm is complied with. A passing-beam cap will generally be used here which intercepts part of the light emitted between the electrode tips such that the beam formed by the lantern avoids dazzling of oncoming traffic.

The optical dimensions, also called the luminance distribution, of the light source are furthermore favorably influenced by a suitable choice of the wall thickness. With a thickness of the wall of the ceramic discharge vessel $d_w \leqq 0.4$ mm the metal halide lamp can be applied in a complex-shape lantern. Although the ceramic wall material in itself has generally strongly light-scattering properties, a light source is here advantageously realized which has optical dimensions comparable to usual dimensions of existing headlamps fitted with incandescent coils.

Preferably, the discharge vessel of the lamp has a wall load of equal to or less than 120 W/cm$^2$. The wall load is defined here as the quotient of the lamp power and the outer surface of that portion of the discharge vessel wall which is situated between the electrode tips.

The virtual decrease of the dimensions of the discharge vessel is from an optical point of view, in particular, of interest for images of the discharge vessel which are projected by the light beam to fulfill the requirements in the so-called cut-off region. According to a preferred embodiment of the metal halide lamp according to the invention, the portion with respect to the longitudinal axis encompasses a segment of the outer bulb with a segment angle $\alpha$ in the range between $20 \leqq \alpha \leqq 110°$. Preferably, $\alpha$ is in the range between $30 \leqq \alpha \leqq 60°$.

A preferred embodiment of the metal halide lamp according to the invention is characterized in that the portion forming the negative lens comprises a flat surface. Such a portion can easily be realized by sawing off a part of the cylindrical outer bulb of the metal halide lamp. The flat portion as compared to the cylindrical outer bulb functions as a negative lens. The virtual dimensions of the discharge vessel can easily by observed by an observer if the observer looks at the discharge vessel through the flat surface of the outer bulb. The observer observes a virtually smaller discharge vessel.

An alternatively preferred embodiment of the metal halide lamp according to the invention is characterized in that the portion forming the negative lens comprises a curved surface which is less curved than the curvature of the remainder of the outer bulb. The less curved curvature of the portion as compared to the curvature of the remainder of the outer bulb functions as a negative lens. In an alternative embodiment, the portion forming the negative lens is inwardly curved in the outer bulb. In that case the outer bulb has a concave portion and a strongly negative lens is obtained.

The virtual decrease of the dimensions of the discharge vessel is from an optical point of view, in particular, of interest for images of the discharge vessel are projected by the light beam to be used for the so-called cut-off region. In an alternatively preferred embodiment of the metal halide lamp according to the invention a first and a second portion of the surface of the outer bulb facing away from the discharge vessel are shaped as a negative lens. Preferably, the first and the second portion are at opposite sides of the outer bulb.

From an optical point of view, the first and second portion would normally be chosen to be parallel to each other. However, it can be advantageous if the portions are a small angle with respect to each other. Therefore, a preferred embodiment of the metal halide lamp according to the invention is characterized, in that the transition between the first portion and the remainder of the outer bulb defines a first plane, in that the transition between the second portion and the remainder of the outer bulb defines a second plane, and in that the first plane and the second plane make an angle with respect to each other which is equal to or less than 10°.

Because the portion(s) may give rise to unwanted reflections which may give rise to an increased glare level in the beam pattern, it is advantageous to give at least one of the portions forming the negative lens anti-reflective properties. Such anti-reflective properties can be realized in a manner known to the skilled person by coating the portion with an anti-reflective coating.

The invention will now be explained in more detail with reference to a number of embodiments and a drawing, in which:

FIG. 1 diagrammatically shows a metal halide lamp;

The Figures are purely diagrammatic and not drawn true to scale. Some dimensions are particularly strongly exaggerated for reasons of clarity. Equivalent components have been given the same reference numerals as much as possible in the Figures.

Figure 1:
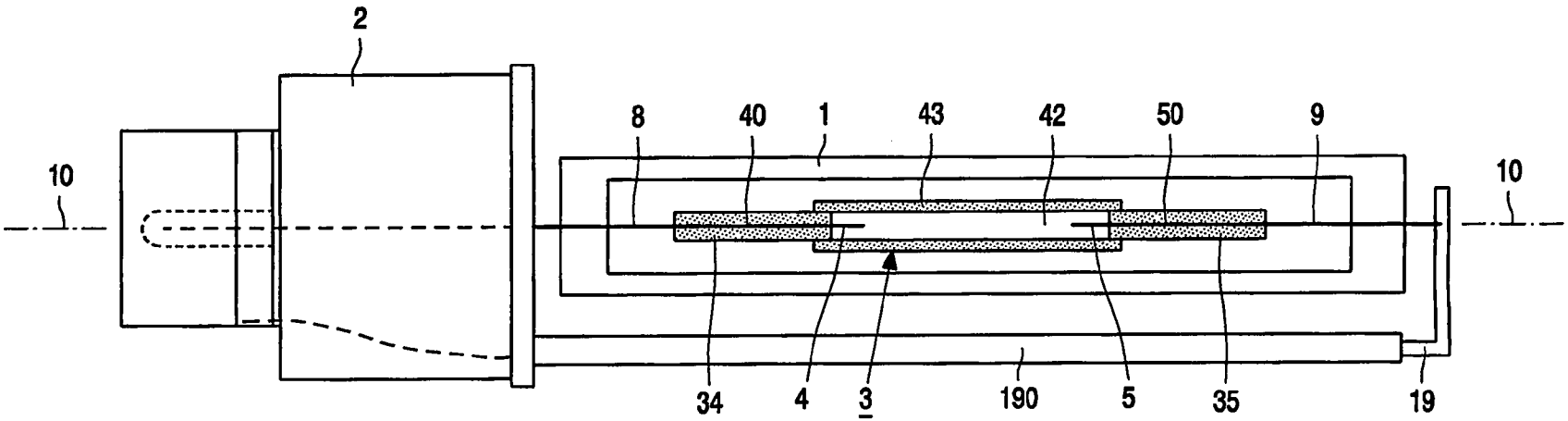

FIG. 1 shows a metal halide lamp provided with a cylindrically-shaped discharge vessel 3 and a cylindrically-shaped outer bulb 1 along a longitudinal axis 10. The discharge vessel 3 has a ceramic wall 43 which encloses a discharge space 42 containing Xe and an ionizable filing with NaI and $CeI_3$. Xe is added to the ionizable filling of the discharge vessel with a high filling pressure. The Xe ensures a fast lumen output immediately after ignition of the lamp. The choice of the filling pressure of the rare gas in addition influences the heat balance of the discharge vessel and thus the useful life of the lamp. It was found that a pressure of at least 5 bar is required for realizing a lamp life of 40,000 switching operations. Preferably, the filling pressure lies in a range from 7 bar to 20 bar, more in particular from 10 bar to 20 bar. This offers a possibility of realizing switching lives of a relatively very high number of switching operations.

Two electrodes 4 and 5 are arranged in the discharge vessel 3, which has an internal diameter $d_i \leqq 2$ mm. The discharge vessel is closed off at either end by a respective ceramic projecting (extruded) plug 34, 35 which encloses with narrow interspacing a respective current lead-through conductor 40, 50 to the electrode 4, 5 arranged in the discharge vessel and which is connected to the relevant conductor in a gastight manner by means of a melting-ceramic joint (not shown in FIG. 1) at an end facing away from the discharge space. The discharge vessel is surrounded by a cylindrically-shaped outer bulb 1 (see FIGS. 2A, 3A and 3B). The metal halide lamp is further provided with a lamp cap socket 2. A discharge extends between the electrodes 4 and 5 in the operational state of the lamp. The electrode 4 is connected to a first electrical contact forming part of the lamp cap socket 2 via a current conductor 8. The electrode 5 is connected to a second electrical contact forming part of the lamp cap socket 2 via current conductors 9 and 19. The current conductor 19 is surrounded by a ceramic tube 190.

Figure 2A:
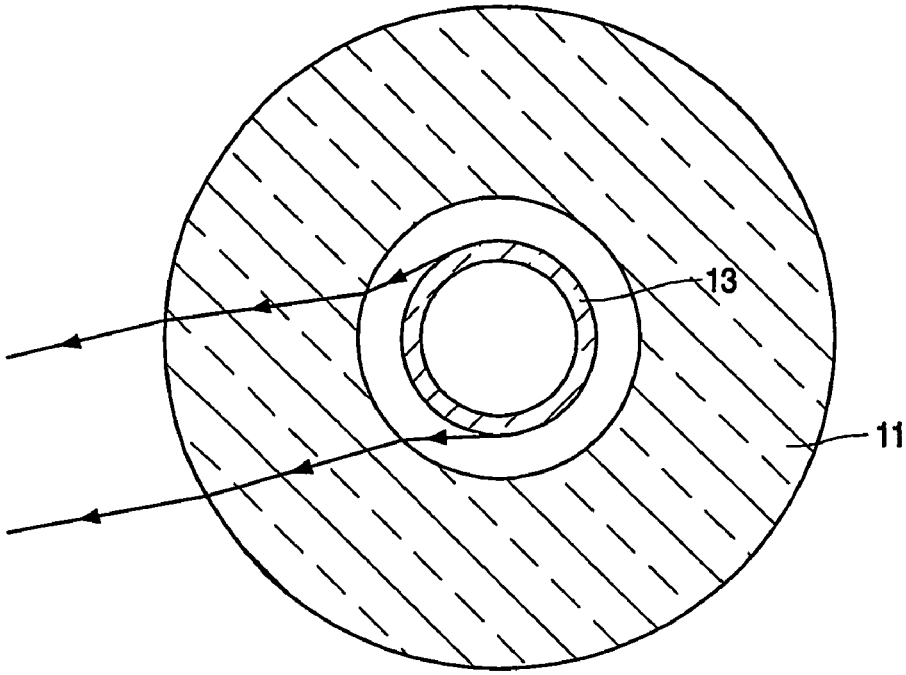
FIG. 2A shows a cross-section of the discharge vessel and the outer bulb of a known metal halide lamp of FIG. 1.

FIG. 2A shows a cross-section of the discharge vessel 13 and the outer bulb 11 of a known metal halide lamp of FIG. 1. The cross-section is shown in a plane perpendicular to the longitudinal axis 10 in FIG. 1. In the known metal halide lamp the discharge vessel 13 and the outer bulb 11 are circularly shaped. FIG. 2A also shows two so-called "extreme" light rays directed to a imaginary point at 50 mm distance from the center of the discharge vessel (the center coincides with a point on the longitudinal axis 10 in FIG. 1) on a parabolic reflector (not shown in FIG. 2A) with a focal point of 25 mm perpendicular to the longitudinal axis 10. The angle between the so-called "extreme" light rays is a measure for the virtual size of the discharge vessel (a relatively large angle corresponds to a relatively large virtual size of the discharge vessel).

Figure 2B:
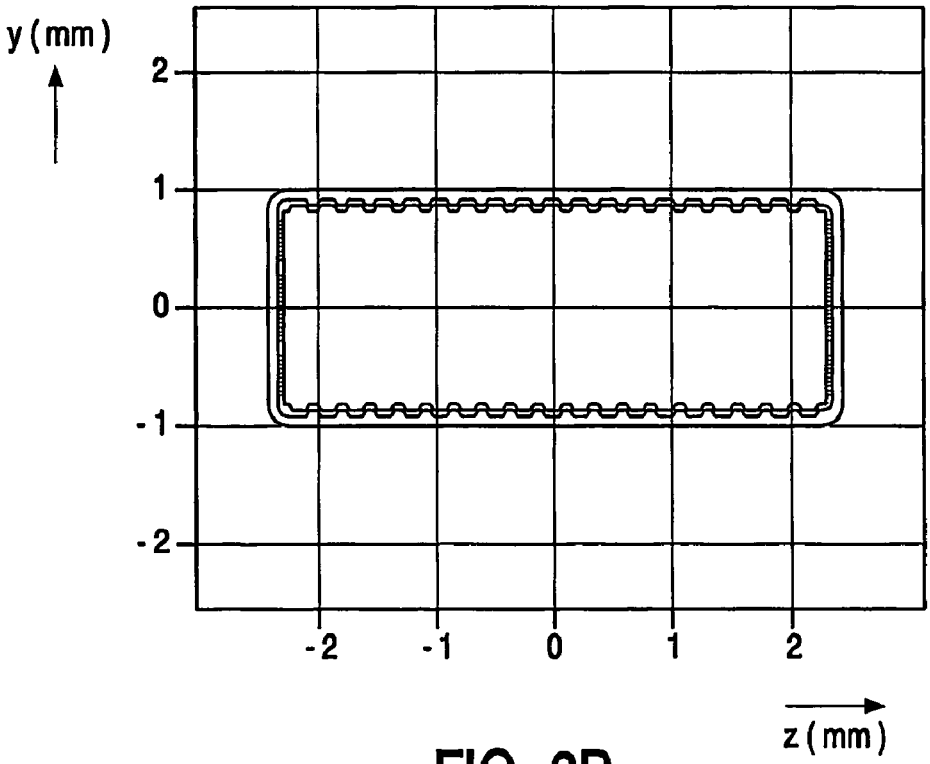
FIG. 2B shows an image of the known metal halide lamp of FIG. 2A calculated by means of ray tracing.

FIG. 2B shows an image calculated by means of ray tracing of the known metal halide lamp of FIG. 2A observed at an imaginary point. The imaginary point is at a distance of 50 mm from the center of the discharge vessel. The image in FIG. 2B is displayed in the zy-plane, wherein the z-axis is the longitudinal axis (lamp axis). The dimensions of the image along the y-axis in FIG. 2B are a measure of the virtual external diameter of the discharge vessel 13 corresponding to the distance of the "extreme" light rays in FIG. 2A. For the known metal halide lamp the virtual diameter of the discharge vessel 13 is practically the same as the actual diameter of the discharge vessel 13, i.e. approximately 2 mm. The dimensions of the discharge vessel 13 in the known metal halide lamp give rise to relatively high wall temperatures in the discharge vessel 13. These relatively high wall temperatures have a detrimental influence on the lifetime of the metal halide lamp.

Figure 3A:
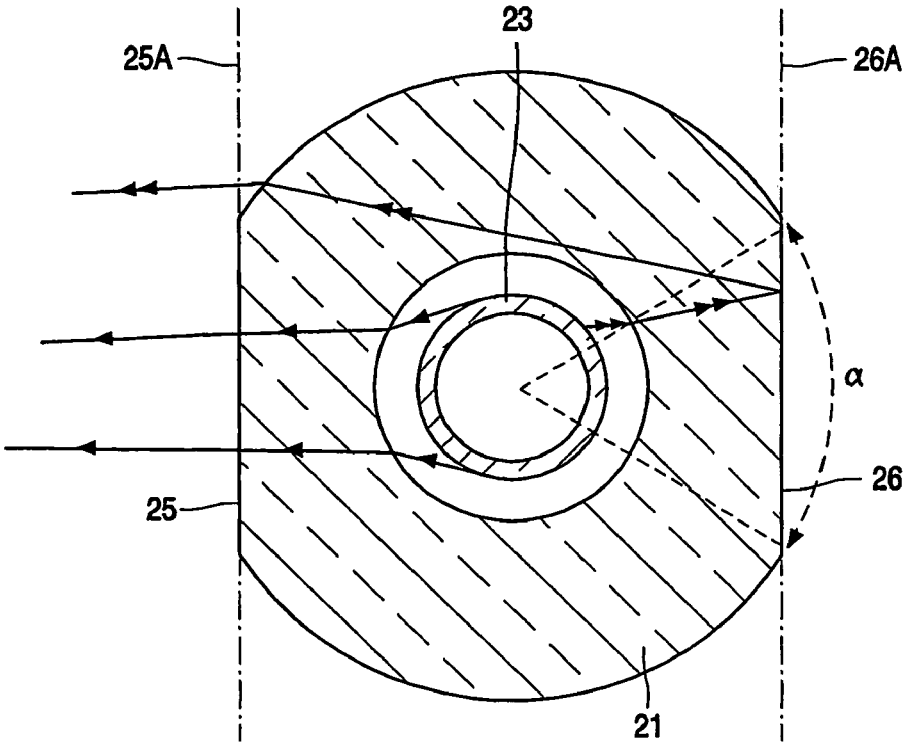
FIG. 3A shows a cross-section of the discharge vessel and the outer bulb of an embodiment of a metal halide lamp of FIG. 1 in detail.

FIG. 3A shows a cross-section of the discharge vessel 23 and the outer bulb 21 according to an embodiment of the invention of a metal halide lamp of FIG. 1 in detail. The cross-section is shown in a plane perpendicular to the longitudinal axis 10 in FIG. 1. In the example of FIG. 3A the internal diameter of the outer bulb 21 is approximately 3 mm and the outer diameter of the outer bulb 21 is approximately 7 mm. In the metal halide lamp according to this embodiment of the invention, a portion 25, 26 of the outer bulb 21 is formed as a flat surface. Such a portion 25, 26 can easily be produced by sawing off a part of the cylindrical outer bulb 21. It is not necessary that the flat portion of the outer bulb extends over the entire length of the outer bulb 21; in principle it is sufficient to cut away only a part that is somewhat larger (e.g. 4-5 mm larger) than the size of the discharge vessel 23, i.e. approximately the distance between the two electrodes in the discharge vessel 23. In the example of FIG. 3A the outer bulb 21 is provided with two flattened portions with respective reference numerals 25 and 26 at opposite sides of the outer bulb. In an alternative embodiment the outer bulb is provided with only one flat portion. The flat portion 25, 26 functions as negative lens. The flat portion 25, 26 with respect to the longitudinal axis 10 (see FIG. 1) encompasses a segment of the outer bulb with a segment angle $\alpha$ in the range between $30 \leqq \alpha \leqq 60°$. This range is set by the way images are projected in the vicinity of the so-called cut-off region following from the requirements for automotive passing beam patterns (ECE R98 requirements).

In FIG. 3A the transition between the first portion 25 and the remainder of the outer bulb 21 defines a first plane (in the example of FIG. 3A the plane coincides with the surface of the flat portion 25) indicated in the cross-section in FIG. 3A by line 25A. In addition, the transition between the second portion 26 and the remainder of the outer bulb 21 defines a second plane (in the example of FIG. 3A the plane coincides with the surface of the flat portion 26) indicated in the cross-section in FIG. 3A by line 26A. Preferably, the first plane and the second plane are parallel to each other (i.e. the lines 25A and 26A are parallel with respect to each other). In an alternative embodiment the first and the second plane make an angle with respect to each other which angle, preferably is less than 10° (i.e. the lines 25A and 26A are at an angle <10° with respect to each other).

FIG. 3A also shows two so-called "extreme" light rays indicated with one arrow directed to a imaginary point at 50 mm distance from the center of the discharge vessel (the center coincides with a point on the longitudinal axis 10 in FIG. 1) on a parabolic reflector (not shown in FIG. 3A) with a focal point of 25 mm perpendicular to the longitudinal axis 10. The angle between said so-called "extreme" light rays is a measure for the virtual size of the discharge vessel 23.

Figure 3B:
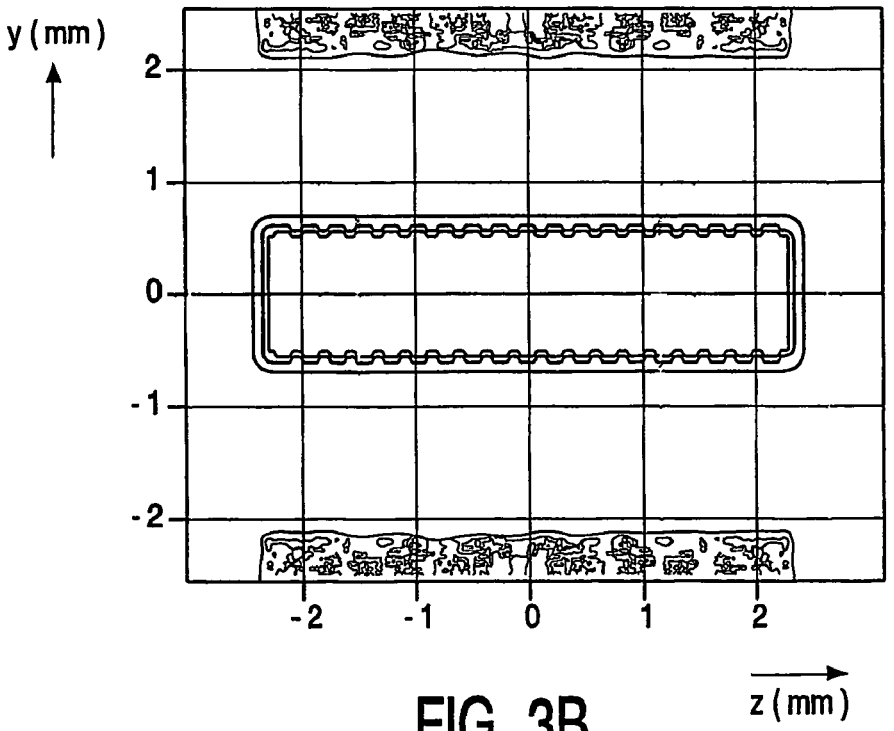
FIG. 3B shows an image of the metal halide lamp of FIG. 3A calculated by means of ray tracing.

FIG. 3B shows an image calculated by means of ray tracing of the metal halide lamp of FIG. 3A observed at an imaginary point. The imaginary point is at a distance of 50 mm from the center of the discharge vessel. The image in FIG. 3B is displayed in the zy-plane. The dimensions of the image along the y-axis in FIG. 3B are a measure of the virtual external diameter of the discharge vessel 23 corresponding to the distance of the "extreme" light rays in FIG. 3A. For the metal halide lamp according to the embodiment of the invention the viral diameter of the discharge vessel 23 is substantially smaller than the actual diameter of the discharge vessel 23, i.e. approximately 70% of 2 mm, i.e. approximately 1.4 mm. The dimensions of the discharge vessel 23 in the metal halide lamp according to the embodiment of the invention give rise to lower wall temperatures in the discharge vessel 23. These relatively low wall temperatures have a significant positive influence on the lifetime of the metal halide lamp.

In the upper and lower part of FIG. 3B some relatively weak reflection images are visible originating from the portion in FIG. 3A with reference numeral 26. Such reflections may give rise to an increased glare level in the beam pattern. The manner in which these relatively weak reflection images can be formed is schematically indicated in FIG. 3A by the ray indicated with two arrows. The effect of such undesired rays reflections can largely be reduced by applying an anti-reflex coating (not shown in FIG. 3A) on the flat surface of the portion 26.

Figure 4A:
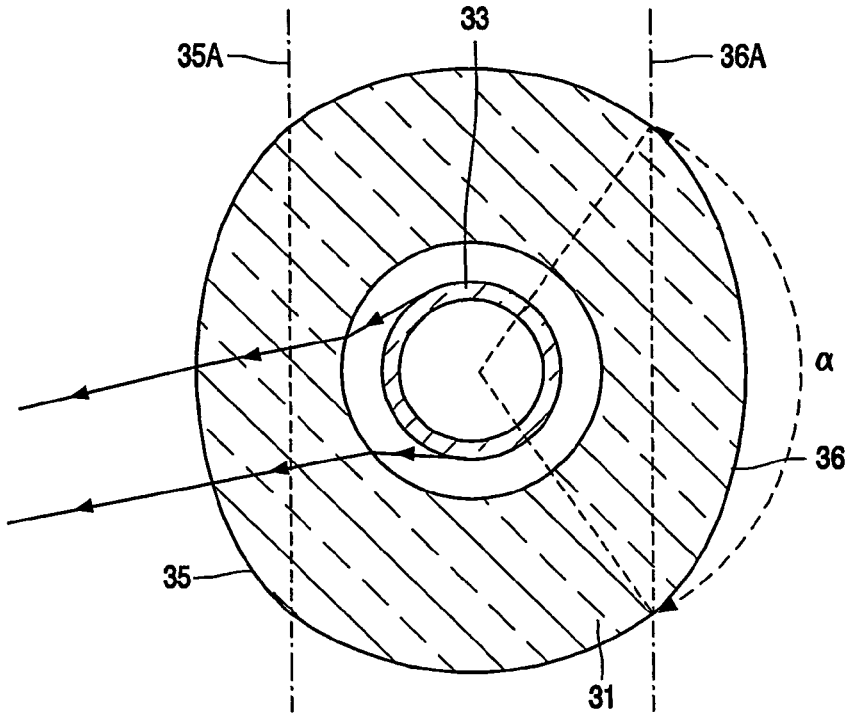
FIG. 4A shows a cross-section of the discharge vessel and the outer bulb of an alternative embodiment of a metal halide lamp of FIG. 1 in detail.

FIG. 4A shows a cross-section of the discharge vessel 33 and the outer bulb 31 according to an alternative embodiment of the invention of a metal halide lamp of FIG. 1 in detail. The cross-section is shown in a plane perpendicular to the longitudinal axis 10 in FIG. 1. In the example of FIG. 4A the internal diameter of the outer bulb 31 is approximately 3 mm and the outer diameter of the outer bulb 31 is approximately 7 mm. In the example of FIG. 4A the outer bulb 31 is provided with two curved portions with respective reference numerals 35 and 36 at opposite sides of the outer bulb. The curved portion 35, 36 is less curved than the curvature of the remainder of the outer bulb 31 (i.e. the radius of the curved portion is larger than the radius of the remainder of the outer bulb). In an alternative embodiment the outer bulb is provided with only one curved portion. The curved portion 35, 36 functions as negative lens. The curved portion 35, 36 with respect to the longitudinal axis 10 (see FIG. 1) encompasses a segment of the outer bulb with a segment angle $\alpha$ in the range between $20 \leqq \alpha \leqq 110°$. This range is set by the way images are projected in the vicinity of the so-called cut-off region following from the requirements for automotive passing beam patterns (ECE R98 requirements).

In FIG. 4A the transition between the first portion 35 and the remainder of the outer bulb 31 defines a virtual plane indicated in the cross-section in FIG. 4A by line 35A. In addition, the transition between the second portion 36 and the remainder of the outer bulb 31 defines a second virtual plane indicated in the cross-section in FIG. 4A by line 36A. Preferably, the first plane and the second plane are parallel to each other (i.e. the lines 35A and 36A are parallel with respect to each other). In an alternative embodiment the first and the second plane make an angle with respect to each other which angle, preferably is less than 10° (i.e. the lines 35A and 36A are at an angle <10° with respect to each other).

FIG. 4A also shows two so-called "extreme" light rays directed to a imaginary point at 50 mm distance from the center of the discharge vessel (the center coincides with a point on the longitudinal axis 10 in FIG. 1) on a parabolic reflector (not shown in FIG. 4A) with a focal point of 25 mm perpendicular to the longitudinal axis 10. The angle between said so-called "extreme" light rays is a measure for the virtual size of the discharge vessel 33.

Figure 4B:
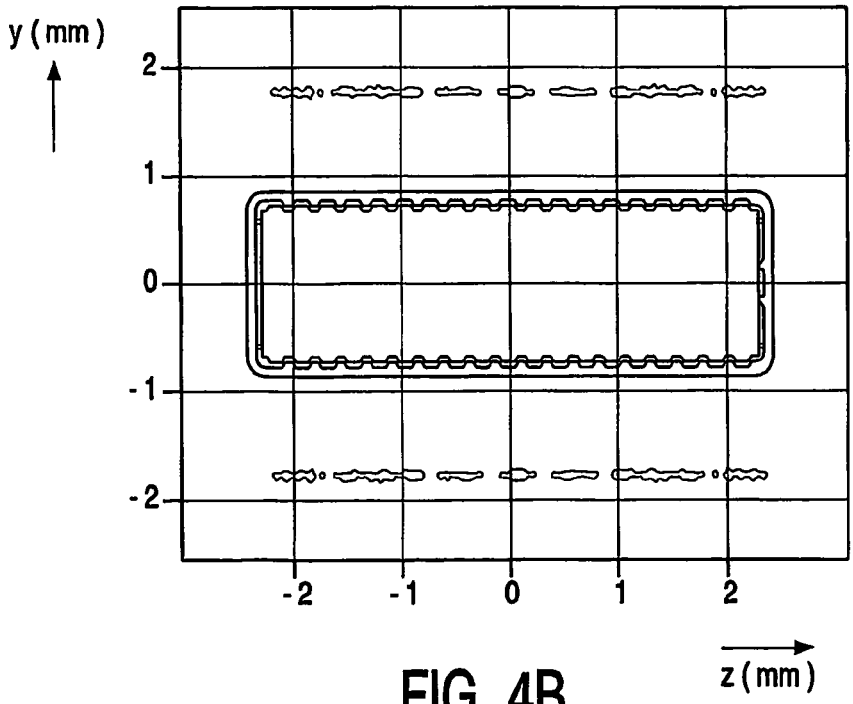
FIG. 4B shows an image of the metal halide lamp of FIG. 4A calculated by means of ray tracing, and FIG. 5 gives an artists impression of a vehicle headlamp comprising a combination of a metal halide lamp in a complex shape reflector.

FIG. 4B shows an image calculated by means of ray tracing of the metal halide lamp of FIG. 4A observed at an imaginary point. The imaginary point is at a distance of 50 mm from the center of the discharge vessel. The image in FIG. 4B is displayed in the zy-plane. The dimensions of the image along the y-axis in FIG. 4B are a measure of the virtual external diameter of the discharge vessel 33 corresponding to the distance of the "extreme" light rays in FIG. 4A. For the metal halide lamp according to the embodiment of the invention the virtual diameter of the discharge vessel 33 is smaller than the actual diameter of the discharge vessel 33, i.e. depending on the chose curvature approximately 85% of 2 mm, i.e. approximately 1.7 mm. The dimensions of the discharge vessel 33 in the metal halide lamp according to the alternative embodiment of the invention give rise to lower wall temperatures in the discharge vessel 33. These relatively low wall temperatures have a significant positive influence on the lifetime of the metal halide lamp.

In the upper and lower part of FIG. 4B some very weak reflection images as compared to the reflection images as displayed in FIG. 3B. Due to the different design of the outer bulb 31 in FIG. 3A as compared to design of the outer bulb 21 in FIG. 2A the effect of the reflections is largely reduced. On the other hand the image projected in FIG. 4B is somewhat larger than the image projected in FIG. 3B.

The metal halide lamp preferably has a luminous efficacy of ≧80 lm/W in its operational state. The light radiated by the lamp has values for CRI and CCT of 65 and 3500 K, respectively, at a lamp life of 250 hours. The values of the above quantities have become ≦75 lm/W, ≈60-65 and ≈3650 K after 2000 hours of operation.

In an alternative embodiment of the lamp according to the invention, the outer bulb is provided with a heat-reflecting coating at the area of the ceramic projecting plug. This coating may be used in combination with a coating on the discharge vessel as well as instead of an external coating on the discharge vessel. Preferably, the reflecting coating is provided on the inner surface of the wall of the outer bulb, since this method leads to a smaller loss in luminous flux in the beam than in the case of an externally provided coating.

Figure 5:
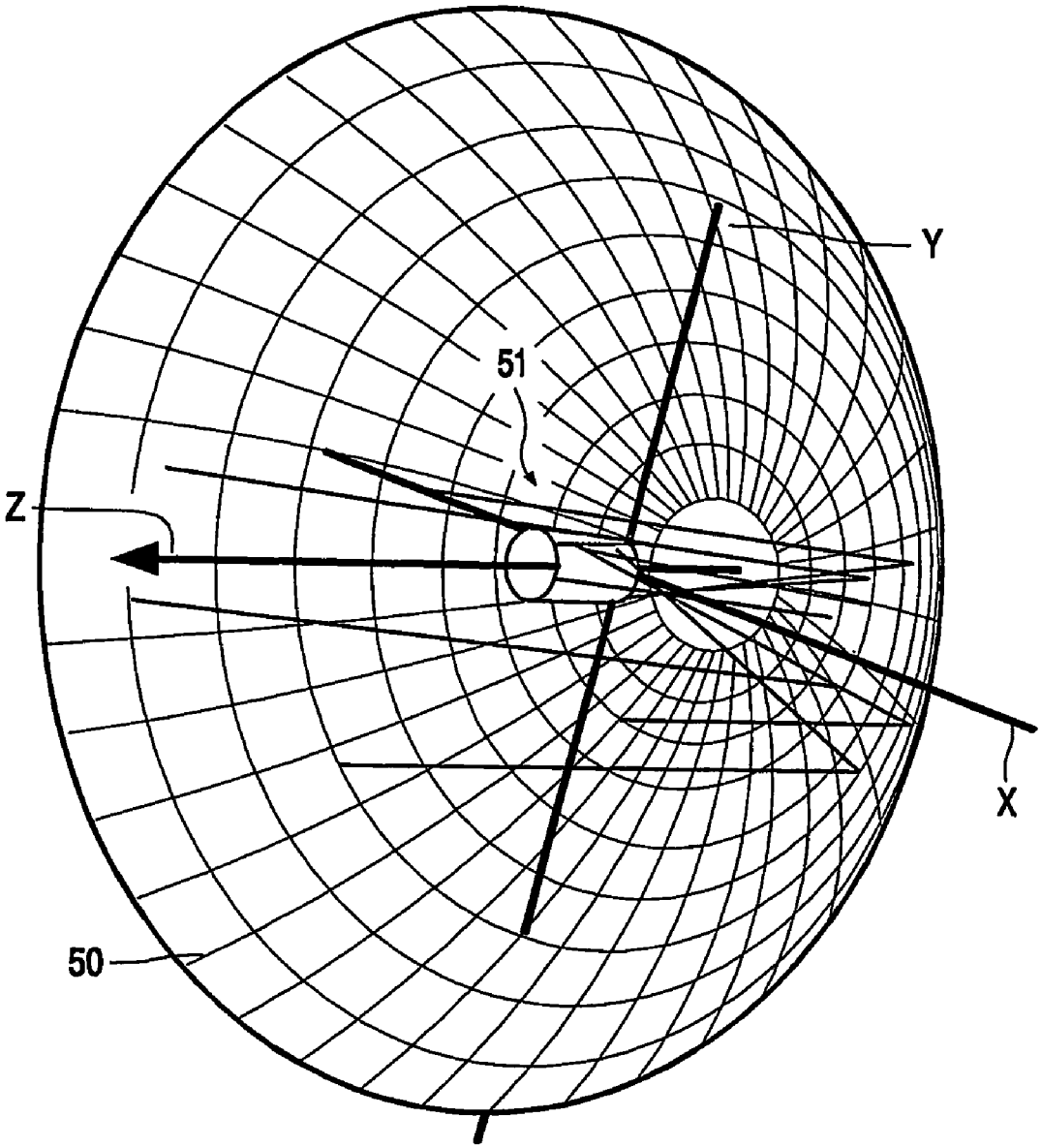

FIG. 5 gives an artists impression of a vehicle headlamp comprising a combination of a metal halide lamp 51 according to the invention in a complex shape parabolic reflector 50. The metal halide lamp comprise a cylindrically-shaped discharge vessel and a cylindrically-shaped outer bulb along the z-axis, i.e. the longitudinal axis in FIG. 1. Some light rays originating from the metal halide lamp 51 and reflected by the reflector 50 are schematically indicated in FIG. 5.

Preferably, the portions forming the negative lenses are oriented in the direction of portions of the reflector creating a cut-off between the illuminated area and the glare area according to requirements for automotive passing beam patterns (ECE R98 requirements).

The scope of the invention is not limited to the embodiments. The invention is embodied in each new characteristic and each combination of characteristics. Any reference sign do not limit the scope of the claims. The word "comprising" does not exclude the presence of other elements or steps than those listed in a claim. Use of the word "a" or "an" preceding an element does not exclude the presence of a plurality of such elements.

The invention claimed is:

1. A metal halide lamp, comprising:

a cylindrically-shaped discharge vessel along a longitudinal axis, said discharge vessel having a ceramic wall which encloses a discharge space comprising Xe and an ionizable filling, and an outer bulb surrounding the discharge vessel along the longitudinal axis, a portion of a surface of the outer bulb facing away from the discharge vessel being shaped as a negative lens, wherein a virtual image of the discharge vessel is created by the negative lens so that dimensions of the virtual image are smaller than dimensions of the discharge vessel, the discharge vessel and the outer bulb defining a circumferential space therebetween, wherein the portion with respect to the longitudinal axis encompasses a segment of the outer bulb with a segment angle $\alpha$ in a range between $20° \leqq \alpha \leqq 110°$.

2. The metal halide lamp of claim 1, wherein the portion forming the negative lens comprises a flat surface.

3. The metal halide lamp of claim 1, wherein the portion forming the negative lens comprises a curved surface which is less curved than a curvature of a remainder of the outer bulb.

4. The metal halide lamp of claim 1, wherein a first portion and a second portion of the surface of the outer bulb facing away from the discharge vessel are shaped as negative lenses.

5. The metal halide lamp of claim 4, wherein the first portion and the second portion are at opposite sides of the outer bulb.

6. The metal halide lamp of claim 4, wherein a transition between the first portion and a remainder of the outer bulb defines a first plane, wherein a transition between the second portion and the remainder of the outer bulb defines a second plane, and wherein the first plane and the second plane make an angle with respect to each other which is equal to or less than 10°.

7. The metal halide lamp of claim 4, wherein at least one of the portions forming the negative lenses has anti-reflective properties.

8. A vehicle headlamp comprising a reflector and the metal halide lamp of claim 1.

9. The vehicle headlamp of claim 8, wherein the portion forming the negative lens is oriented in the direction of portions of the reflector creating a cut-off between an illuminated area and a glare area according to requirements for automotive passing beam patterns.

10. The metal halide lamp of claim 1, wherein the segment angle $\alpha$ is in a range between $60° \leqq \alpha \leqq 90°$.

11. The metal halide lamp of claim 1, wherein the segment angle $\alpha$ is in a range between $30° \leqq \alpha \leqq 60°$.

* * * * *